United States Patent [19]

Hinz

[11] Patent Number: 4,825,882

[45] Date of Patent: May 2, 1989

[54] APPARATUS FOR ROLLING UNITING BANDS AROUND GROUPS OF ROD-SHAPED ARTICLES

[75] Inventor: Werner Hinz, Lauenburg, Fed. Rep. of Germany

[73] Assignee: Körber AG, Hamburg, Fed. Rep. of Germany

[21] Appl. No.: 144,562

[22] Filed: Jan. 15, 1988

[30] Foreign Application Priority Data

Jan. 31, 1987 [DE] Fed. Rep. of Germany ..... 3702915

[51] Int. Cl.[4] ..... A24C 5/52

[52] U.S. Cl. ..... 131/94

[58] Field of Search ..... 131/94

[56] References Cited

U.S. PATENT DOCUMENTS

| | | | |
|---|---|---|---|
| 3,483,873 | 12/1969 | Hinzmann | 131/94 |
| 3,527,234 | 9/1970 | Hinzmann | 131/94 |
| 3,564,902 | 2/1971 | Heitmann | 73/37 |
| 4,262,680 | 4/1981 | Hinzmann | 131/94 |

*Primary Examiner*—V. Millin
*Assistant Examiner*—Joe H. Cheng
*Attorney, Agent, or Firm*—Peter K. Kontler

[57] ABSTRACT

Apparatus for convoluting adhesive-coated uniting bands around groups of coaxial plain cigarettes and filter rod sections in a filter tipping machine has a drum-shaped conveyor whose peripheral surface has equidistant axially parallel flutes for discrete groups and suction ports to attract uniting bands behind the groups as well as to attract the groups to the respective flutes during certain parts of each revolution of the conveyor. Successive groups are caused to roll about their own axes to thereby convert the adjacent uniting bands into tubes during travel through an arcuate gap which is defined by the peripheral surface of the conveyor and the adjacent concave surface of a stationary rolling member. In order to prevent abrupt setting of successive groups into rotary motion about their axes, the apparatus employs a rotor with radially extending projections which are adjacent the inlet of the gap and are caused to orbit at a speed less than the peripheral speed of the conveyor so that each group is set in rotary motion about its axis in two stages, first at a lower speed by a projection and thereupon at a higher speed by the concave surface. This reduces the likelihood of defacing and/or otherwise affecting the desirable characteristics of the groups of rod-shaped articles and of the uniting bands.

12 Claims, 1 Drawing Sheet

APPARATUS FOR ROLLING UNITING BANDS AROUND GROUPS OF ROD-SHAPED ARTICLES

BACKGROUND OF THE INVENTION

The invention relates to improvements in apparatus for convoluting or rolling adhesive-coated uniting bands around rod-shaped commodities, especially around groups of coaxial rod-shaped articles of the tobacco processing industry.

Apparatus of the type to which the present invention pertains are disclosed, for example, in commonly owned U.S. Pat. No. 3,483,873 granted Dec. 16, 1969 to Alfred Hinzmann for "Apparatus for making holes in tobacco rods or the like" and in commonly owned U.S. Pat. No. 3,527,234 granted Sep. 8, 1970 to Alfred Hinzmann for "Apparatus for convoluting uniting bands around rod-shaped articles". As a rule, such convoluting or rolling apparatus comprise a rotary drum-shaped conveyor which carries a series of adhesive-coated uniting bands, each adjacent a group of rod-shaped articles, and a stationary rolling member which defines with the conveyor a gap wherein the groups of coaxial rod-shaped articles are caused to roll about their own axes in order to thereby convolute the uniting bands therearound. This results in conversion of the groups and of the respective uniting bands into smokers' articles (particularly filter cigarettes of multiple unit length) wherein the uniting band forms a tube surrounding the abutting ends of the respective rod-shaped articles. For example, each filter cigarette can comprise two plain cigarettes of unit length flanking a filter mouthpiece of double unit length, and a tube which is the converted uniting band and surrounds the filter mouthpiece as well as the adjacent inner end portions of the plain cigarettes. Many filter tipping machines which employ such rolling or convoluting apparatus are known as MAX and MAX S (both manufactured by the assignee of the present application).

The output of filter tipping machines is on the increase, practically from year to year. Each such increase of output invariably creates problems in certain parts of filter tipping machines. For example, the previously used testing units must be redesigned, or entirely new testing units must be invented, in order to be capable of adequately monitoring the condition of filter cigarettes which are turned out at the rate of many thousands per minute. Analogously, conventional apparatus which are used in such machines to roll uniting bands around groups of plain cigarettes and filter mouthpieces often cannot do the job without defacing, damaging and/or otherwise adversely affecting the appearance and/or other desirable characteristics of the products. For example, abrupt rolling of successive groups of coaxial rod-shaped articles about their axes from zero rolling speed to maximum rolling speed can result in the escape of large quantities of tobacco particles at the exposed ends of plain cigarettes, and abrupt engagement with a stationary rolling surface can cause damage to the uniting bands and/or to the wrappers of individual rod-shaped articles of the groups.

OBJECTS AND SUMMARY OF THE INVENTION

An object of the invention is to provide a novel and improved apparatus which can convolute or drape adhesive-coated uniting bands around successive groups of coaxial rod-shaped articles at high frequency without affecting the appearance and/or other desirable characteristics of the articles and/or uniting bands.

Another object of the invention is to provide the apparatus with novel and improved means for initiating the rolling of groups of articles around their respective axes to thus start the rolling or convoluting operation.

A further object of the invention is to provide the apparatus with novel and improved means for treating many thousands of groups of rod-shaped articles and uniting bands per minute without sacrificing the quality of treatment and without increasing the number of rejects.

An additional object of the invention is to provide a machine or a production line which embodies the above outlined apparatus.

Still another object of the invention is to provide a novel and improved method of convoluting adhesive-coated uniting bands around groups of coaxial rod-shaped articles, especially around groups of plain cigarettes and filter mouthpieces in filter tipping machines.

A further object of the invention is to provide a novel and improved combination of rolling devices for use in a filter tipping machine which is designed for mass production of filter cigarettes, cigars or cigarillos.

Another object of the invention is to provide relatively simple and inexpensive rolling devices which can be installed in existing filter tipping and analogous machines so as to enable such machines to turn out larger quantities of rod-shaped smokers' products without affecting the quality of the products and without increasing the percentage of rejects at the rolling or convoluting station.

The apparatus of the present invention is used to convolute adhesive-coated uniting bands around rod-shaped commodities, particularly to convolute uniting bands around groups of coaxial rod-shaped articles of the tobacco processing industry (for example, to convolute adhesive coated uniting bands about filter mouthpieces of double unit length and around the adjacent end portions of pairs of plain cigarettes of unit length in a filter tipping machine). The apparatus comprises a conveyor having a supporting surface serving to carry and advance a series of uniting bands and a commodity adjacent each uniting band along a predetermined path and in a predetermined direction such that the commodities extend substantially at right angles to the predetermined direction and are adjacent to or actually contact the leaders of the respective uniting bands, and a plurality of devices for rolling the commodities about their respective axes along the supporting surface and relative to the respective uniting bands so as to convolute the uniting bands (which are coated with adhesive) around the respective commodities. In accordance with a feature of the invention, the rolling devices include a first rolling device having first rolling means for rolling successive commodities at a lesser first speed, and a second device having second rolling means for thereafter rolling successive commodities at a greater second speed.

The second rolling means preferably includes a second surface which is adjacent a portion of the predetermined path and defines with the supporting surface a gap having a width such that successive commodities entering the gap contact and are rotated by the second surface about their respective axes to thereby roll along the supporting surface. The supporting surface can constitute a convex surface, and the second surface is then a concave surface which is preferably provided on a rigid stationary rolling member constituting or forming part of the second rolling device.

The gap has an inlet for successive uniting bands and the respective commodities, and an outlet. The first rolling device can include a rotor which is adjacent the predetermined path upstream of the second rolling device and has a plurality of peripheral projections (e.g., in the form of radially outwardly extending paddles, teeth, webs or ribs) which serve to frictionally engage successive commodities in the region of the inlet of the gap. The conveyor includes means for moving the supporting surface at a first speed, and the first rolling device further includes means for orbiting the projections at a second speed which is less than the first speed. In accordance with a presently preferred embodiment, the first speed is or can be substantially twice the second speed.

The conveyor can constitute a rotary conveyor and the moving means then includes means for rotating the conveyor in a first direction. The aforementioned orbiting means can include means (e.g., a shaft) for driving the rotor in a second direction counter to the first direction so that the projections which are adjacent the predetermined path move in the direction of advancement of commodities with the supporting surface but at a lesser speed.

The projections on the rotor can form at least one annulus, and the second rolling device is preferably provided with a slot for the projections of the at least one annulus so that portions of the projections can enter the inlet of the gap.

The supporting surface of the conveyor can be provided with spaced-apart equidistant receiving means in which the commodities are partly received ahead of the inlet of the gap. The projections can form the aforementioned at least one annulus of spaced-apart equidistant projections, and the mutual spacing of projections forming such annulus is less than the mutual spacing of the receiving means. Each receiving means can constitute or include a flute in the supporting surface of the conveyor, and the latter preferably further comprises suction ports and/or other suitable means for attracting the commodities to the respective flutes and for attracting the uniting bands to the supporting surface in predetermined portions of the aforementioned path.

One of the rolling means (particularly the second surface) can be designed to roll the commodities about their respective axes through angles of more than 360 degrees, e.g., to cause each commodity to roll about its axis several times during travel from the inlet to the outlet of the gap between the supporting and second surfaces.

The improved method serves to convolute adhesive-coated uniting bands around groups of coaxial rod-shaped articles, such as groups of plain cigarettes and filter mouthpieces in a filter tipping machine. The method comprises the steps of conveying a series of at least substantially equidistant groups along a predetermined path in a predetermined direction substantially at right angles to their respective axes and next to discrete uniting bands, setting successive groups of the series in rotary motion about their respective axes at a first speed so that the groups initiate conversion of the respective uniting bands into tubes which ultimately surround the groups, and thereupon rotating the already rotating successive groups about their respective axes at a higher second speed to thus advance (e.g., to completion) the conversion of uniting bands into tubes.

The step of setting successive groups of the series in rotary motion about their respective axes can include frictionally engaging successive groups with successive projections of at least one annulus of projections which orbit adjacent a selected portion of the predetermined path at a speed less than the speed of movement of the groups along the predetermined path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
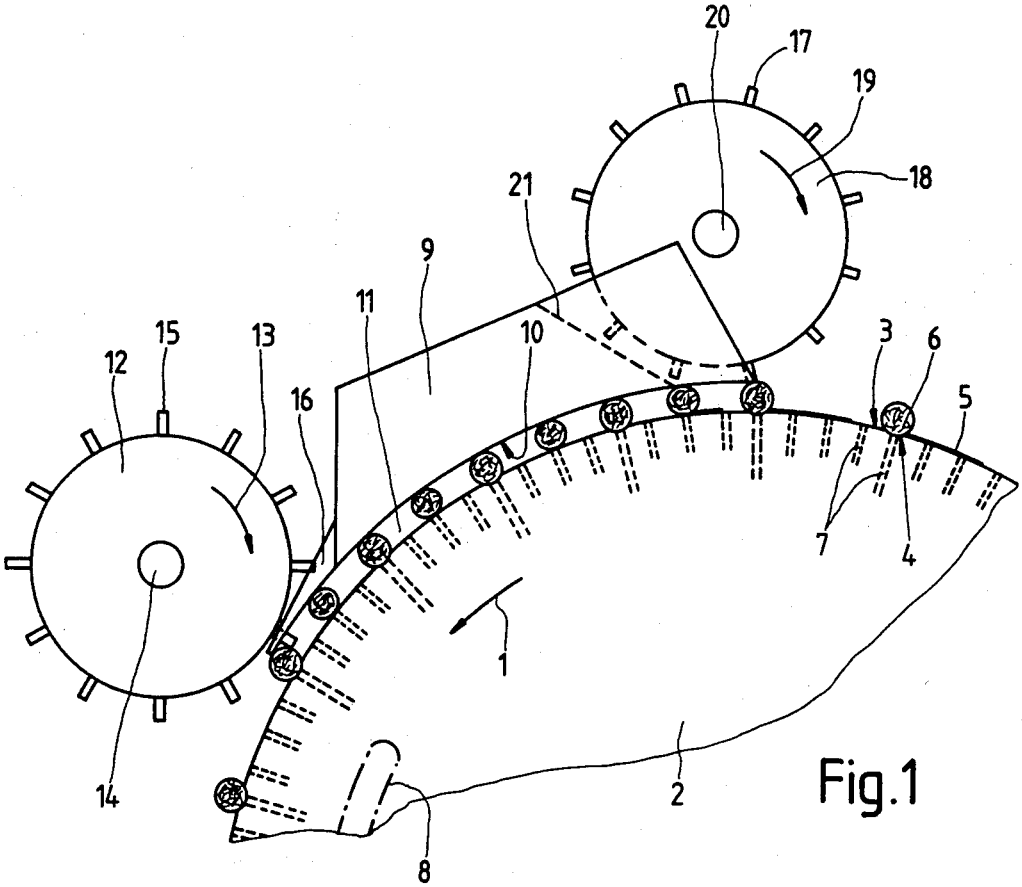
FIG. 1 is a fragmentary schematic elevational view of a rolling or convoluting apparatus which is used in a filter tipping machine and embodies one form of the present invention.

FIG. 1 shows a portion of a filter tipping machine, for example, of the type shown in commonly owned U.S. Pat. No. 4,262,680 granted Apr. 21, 1981 to Alfred Hinzmann for "Method and apparatus for attaching filter plugs to cigarettes or the like". More specifically, the apparatus of FIG. 1 serves to convolute adhesive-coated uniting bands 5 around neighboring commodities 6 each of which constitutes a group of two or more coaxial rod-shaped articles of the tobacco processing industry. A group normally contains two coaxial plain cigarettes of unit length and a filter mouthpiece of double unit length between them. The uniting bands 5 must be convoluted around the respective commodities or groups 6 in such a way that they form tubes each of which completely surrounds the respective filter mouthpiece as well as the adjacent inner end portions of the respective plain cigarettes of unit length. In this manner, each group 6 and the respective uniting band 5 is converted into a filter cigarette of double unit length which is thereupon severed midway across the convoluted uniting band to yield two filter cigarettes of unit length.

The apparatus of FIG. 1 comprises a rotary drum-shaped conveyor 2 which is driven by its shaft (note, for example, the shaft 23 in FIG. 1 of Hinzmann U.S. Pat. No. 3,527,234) to rotate in a counterclockwise direction (arrow 1) and has a convex (cylindrical) peripheral supporting surface 3 provided with a set of spaced-apart equidistant receiving means in the form of shallow flutes 4 extending in parallelism with the axis of the conveyor 2 and each serving to receive a portion of a group 6 while such group is in the process of advancing toward the rolling or convoluting station of the improved apparatus. Successive flutes 4 receive discrete groups 6 from a feeding conveyor which is not specifically shown in the drawing but can correspond to the conveyor 12 shown in FIG. 1 of Hinzmann U.S. Pat. No. 4,262,680. This patent further shows a prime mover PM for all or nearly all moving parts of the filter tipping machine including the convoluting apparatus. The supporting surface 3 of the conveyor 2 is further formed with suitably distributed suction ports 7 some of which serve to attract the uniting bands 5 so that the adhesive-coated sides of the uniting bands face outwardly, and some of which serve to attract the groups 6 in the respective flutes 4 in certain portions of the predetermined arcuate path which is defined by the conveyor 2 for a series of uniting bands 5 and adjacent groups 6, such series extending from the aforementioned feeding conveyor to a receiving conveyor (note the conveyor 24 in FIG. 1 of Hinzmann U.S. Pat. No. 4,262,680) and through the rolling or convoluting station which is located between the feeding and receiving conveyors. As a rule, the feeding conveyor delivers successive groups 6 in such a way that a marginal portion of the respective uniting band 5 adheres to the filter mouthpiece and to the inner end portions of plain cigarettes of the respective group and such marginal portion constitutes the leader of the uniting band on the supporting surface 2. The suction ports 7 can be connected with a suitable suction generating device by way of one or more suction slots or channels 8 in the body of the conveyor 2 while the respective uniting bands 5 and groups 6 advance along one or more predetermined portions of their path. Reference may be had to commonly owned U.S. Pat. No. 3,564,902 granted Feb. 23, 1971 to Uwe Heitmann for "Apparatus and process for testing cigarettes or the like " which discloses one mode of providing a rotary drum-shaped conveyor with suction ports and channels or slots leading to one or more stationary annular or otherwise configurated valve plates disposed at the axial ends of the conveyor and serving to connect the channels or slots with a suction generating device during one or more selected portions of each revolution of the conveyor.

Figure 2:
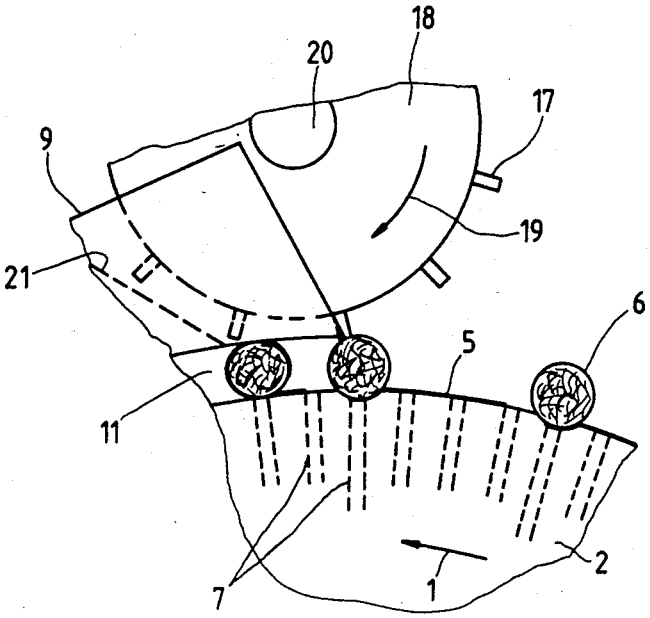
FIG. 2 is an enlarged view of a detail in the apparatus of FIG. 1.

The rolling devices at the rolling station of the improved apparatus include a first rolling device having at least one rotor 18 which is driven by a shaft 20 so as to rotate in a clockwise direction (arrow 19), i.e., counter to the direction of rotation (arrow 1) of the conveyor 2, and has an annulus of equidistant radially outwardly extending rolling means 17 in the form of teeth, paddles, blades, vanes or analogous projections which orbit about the axis of the shaft 20 and serve to initiate the rolling of successive groups 6 about their axes and relative to the supporting surface 3 in a clockwise direction (as seen in FIG. 1 or 2) in order to initiate the conversion of the respective uniting bands into tubes surround the adjacent filter mouthpieces and the inner ends of corresponding plain cigarettes to thus convert each group into a filter cigarette of double unit length.

A second rolling device of the improved apparatus comprises a rigid stationary block-shaped rolling member 9 which is adjacent the path of movement of flutes 4 downstream of the rolling device including the rotor 18 and has a second rolling means 10 in the form of a concave (second) surface whose center of curvature is located on or close to the axis of the conveyor 2 and supporting surface 3. The manner in which the block-shaped rolling member 9 is movably or fixedly secured to a frame member of the filter tipping machine is not shown in the drawing. The arrangement may be such as shown in FIG. 1 of Hinzmann U.S. Pat. No. 4,262,680 wherein the rolling device 23 is mounted on a linkage which can be actuated to move the rolling device 23 away from the rolling conveyor 22 so as to allow for convenient cleaning of the supporting surface of the conveyor 22 as well as of the concave surface of the rolling member 23.

The surfaces 3 and 10 of the conveyor 2 and rolling member 9 define an elongated arcuate channel or gap 11 having a width such that each oncoming group 6 is compelled to contact the concave surface 10 at or immediately downstream of the inlet of the gap 11 and to thus begin to turn about its own axis in a direction to roll over the adjacent uniting band 5 whereby the adhesive-coated external surface of the uniting band adheres to the group and the uniting band begins to form a tube.

The outlet of the gap 11 between the surfaces 3 and 10 is adjacent an aligning wheel 12 which is driven in the direction of arrow 13 by a shaft 14 and carries an annulus of radially outwardly extending projections 15 in the form of teeth, paddles, vanes or the like. The left-hand end portion of the rolling member 9 (at the outlet of the rolling gap 11) has one or more slots or recesses 16 which are milled or otherwise machined into the member 9 and enable the projections 15 to move close to the supporting surface 3 of the conveyor 2. The purpose of the wheel 12 is the same as that of the wheel 93 in FIG. 5 of Hinzmann U.S. Pat. No. 3,527,234, i.e., the projections 15 ensure that each filter cigarette of double unit length which leaves the gap 11 is partially received in and can be attracted to the respective flute 4 on its way toward the aforementioned removing conveyor which accepts successive filter cigarettes of double unit length from the conveyor 2. The projections 15 compensate for eventual misalignment of groups 6 prior to entry into or during travel through the gap 11 and such projections thus guarantee that each filter cigarette of double unit length is invariably transferred into the oncoming flute or an analogous receiving means of the receiving conveyor.

The means for regulating suction in the ports 7 of the conveyor 2 is designed in such a way that the uniting bands 5 are caused to adhere to the supporting surface 3 and the groups 6 are attracted into the respective flutes 4 on their way toward the inlet of the gap 11, i.e., into the range of orbiting projections 17 on the rotor 18. The suction ports 7 are thereupon sealed from the suction generating device during travel along the concave surface 10 of the rolling member 9 but at least some ports are again connected with the suction generating device when they advance from the outlet of the gap 11 toward the receiving conveyor.

The apparatus which is shown in FIGS. 1 and 2 can comprise two or more coaxial aligning wheels 12 which are disposed one behind the other and each of which can have at least one annulus of projections 15. The slot 16 at the left-hand end of the stationary rolling member 9 is then sufficiently wide to enable successive projections 15 of each annulus to move close to the supporting surface 3 and correct, if and when necessary, the orientation of the neighboring filter cigarettes of double unit length so as to ensure that each such cigarette is located in the respective flute 4 not later than when it advances beyond the path of orbital movement of the projections 15. The task of such projections is facilitated by suction in the ports 7 which communicate with the flutes 4 and are preferably connected to the suction generating device as soon as they move beyond the outlet of the gap 11. The arrangement can be such that the suction generating device is connected only with those ports 7 which communicate with the flutes 4 advancing downstream of the gap 11.

The illustrated rotor 18 can also constitute one of two or more coaxial rotors which are mounted on the shaft 20 one behind the other and each of which carries one or more annuli of projections 17. The right-hand end of the stationary rolling member 9 is then formed with several slots or recesses 21 so as to enable successive projections 17 of each annulus of such projections to penetrate into the inlet of the gap 11 and sufficiently close to the peripheral supporting surface 3 of the conveyor 2 to ensure that their tips can frictionally engage the oncoming groups 6 and can cause such groups to roll along the surface 3 in a direction to initiate the conversion of the respective uniting bands 5 into tubes.

In accordance with a feature of the invention, the speed of orbital movement of the projections 17 is less than the speed of movement of flutes 4, i.e., of the supporting surface 3. For example, the speed of the projections 17 can approximate one-third, two-thirds or (preferably) approximately half the peripheral speed of the conveyor 2. This ensures that successive oncoming groups 6 are set in rolling motion about their axes and relative to the supporting surface 3 in several stages. The first stage takes place while the tips of the projections 17 are in frictional engagement with the oncoming groups 6, and this starts the rolling movement from zero speed to an intermediate speed. The rolling speed is increased when the groups 6 advance beyond the path of orbital movement of the projections 17 and are permitted to engage the stationary concave surface 10 of the rolling member 9 at which time each of the groups 6 begins to perform the first of preferably two or more full revolutions about its respective axis and thus ensures that the respective uniting band 5 is invariably converted into a tube which sealingly connects the filter mouthpiece with the adjacent end portions of the respective pair of coaxial plain cigarettes. As the groups 6 approach the respective projections 17, such projections lag relative to the adjacent portions of the supporting surface 3 so that the oncoming groups 6 catch up with the tips of the projections 17 (such tips extend through the respective slot or slots 21 and into the interior of the gap 11 beyond the concave surface 10 at the inlet of the gap) and thereupon move beyond such tips to be immediately thereafter caused to engage the surface 10 on their way toward the outlet of the gap 11. Thus, the surface 10 can be said to constitute a rolling means which cooperates with the supporting surface 3 to ensure that each group 6 is caused to turn about its own axis through an angle exceeding 360 degrees (and preferably several times 360 degrees).

The operation of the improved apparatus will be readily understood upon perusal of the preceding description of FIGS. 1 and 2. Thus, each flute 4 which approaches the rotor 18 contains a portion of a group 6, and such group overlies the leader of the adjacent adhesive-coated uniting band 5. The uniting band 5 is attracted to the peripheral supporting surface 3 and the group 6 is attracted to the surface bounding the respective flute 4 because the corresponding ports 7 are then connected to the suction generating device. Once a group 6 reaches or comes close to the inlet of the gap 11, it engages a (relatively slowly moving) projection 17 of the rotor 18 and remains in frictional engagement with the tip of such projection during advancement into the inlet of the gap 11 so that it starts to convolute the respective uniting band 5 therearound. When this initial stage of the convoluting or rolling operation is completed, the respective group 6 has advanced beyond the path of orbital movement of the projections 17 and expands (if it was deformed by the projection 17) into engagement with the concave surface 10 so that it starts to roll about its own axis and relative to the surface 3 at a higher speed in order to reliably complete the conversion of the associated uniting band 5 into a tube not later than on reaching the outlet of the gap 11. A projection 15 of the wheel 12 then monitors the position and orientation of the thus obtained filter cigarette of double unit length and ensures that the filter cigarette enters the assigned flute 4 not later than before such filter cigarette advances beyond the path of orbital movement of the projections 15. This ensures that the filter cigarettes can be transferred onto the receiving conveyor in a predictable manner and are not defaced and/or otherwise damaged (or even squashed) during such transfer. Each group 6 which advances from the inlet (slot or slots 21) toward the outlet (slot or slots 16) of the gap 11 can roll into and out of two or more successive flutes 4 whose suction ports 7 are then sealed from the suction generating device so that they cannot interfere with the convoluting or rolling operation. The flutes 4 are sufficiently shallow to ensure that a group 6 (and a partly or fully convoluted uniting band 5 thereon) remains in contact with the concave surface 10 of the stationary rolling member 9 while a portion of such group extends into a flute 4.

It will be noted that the mutual spacing of projections 17 of the illustrated annulus of equidistant projections on the rotor 18 is less than the mutual spacing of equidistant flutes 4 in the supporting surface 3 of the conveyor 2.

An advantage of the improved apparatus is that it sets successive groups 6 into rolling motion about their axes in several stages, i.e., that the groups 6 need not be abruptly accelerated from zero rolling speed to maximum rolling speed as a result of direct contact with the stationary surface 10 as in heretofore known rolling or convoluting apparatus. While FIG. 5 of the Hinzmann U.S. Pat. No. 3,527,234 also shows a rotor 94 at the inlet of the arcuate rolling gap C, the rotor 94 serves the same purpose as the aligning wheel 12 of my improved apparatus, i.e., to ensure that each oncoming group is located in one of the flutes in the peripheral surface of the conveyor 91 before such group reaches the gap. Multi-stage acceleration of successive groups 6 to full or maximum rolling speed relative to the supporting surface 3 of the conveyor 2 ensures that the groups are less likely to become misaligned as well as that the groups are less likely to be damaged or defaced in the region of the inlet of the rolling gap 11.

If desired, the apparatus can be designed to set the groups 6 into rolling motion at full speed in more than two stages, e.g., by installing a second rotor or second group of rotors between the illustrated rotor 18 and the median portion of the gap 11 and by driving the second rotor or rotors at a speed such that their projections orbit faster than the projections 17 but at a speed which is still less than the speed of the supporting surface 3. It has been found that, at least in many instances, two-stage acceleration of groups 6 to full rolling speed about their respective axes suffices even if the groups are to be converted into filter cigarettes at a speed greatly exceeding the speed of conversion in heretofore known filter tipping and like machines. Moreover, such higher output is achieved while the groups and the filter cigarettes are treated gently so that the number of rejects attributable to operation of the rolling or convoluting apparatus which embodies the present invention is negligible or nil.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for convoluting adhesive-coated uniting bands around rod-shaped commodities, particularly for convoluting uniting bands around groups of coaxial rod-shaped articles of the tobacco processing industry, comprising a conveyor having a supporting surface arranged to carry and advance a series of uniting bands and a commodity adjacent each uniting band along a predetermined path in a predetermined direction such that the commodities extend substantially at right angles to said direction; and a plurality of devices for rolling commodities along said surface and relative to the respective uniting bands so as to convolute the uniting bands around the respective commodities, including a first device having first rolling means for rolling successive commodities at a lesser first speed and a second device having second rolling means for thereafter rolling successive commodities at a greater second speed.

2. The apparatus of claim 1, wherein said second rolling means includes a second surface adjacent a portion of said path and defining with said supporting surface a gap having a width such that successive commodities entering said gap contact and are rotated by said second surface about their respective axes to thereby roll along said supporting surface.

3. The apparatus of claim 2, wherein said supporting surface is a convex surface and said second surface is a concave surface, said second device including a rigid stationary rolling member.

4. The apparatus of claim 2, wherein said gap has an inlet for successive uniting bands and the respective commodities and an outlet, said first device including a rotor adjacent said path upstream of said second device and having a plurality of peripheral projections arranged to frictionally engage successive commodities in the region of said inlet, said conveyor including means for moving said supporting surface at a first speed and said first device further including means for orbiting said projections at a second speed less than said first speed.

5. The apparatus of claim 4, wherein said first speed is substantially twice said second speed.

6. The apparatus of claim 4, wherein said conveyor is a rotary conveyor and said moving means includes means for rotating said conveyor in a first direction, said orbiting means including means for driving said rotor in a second direction counter to said first direction.

7. The apparatus of claim 4, wherein said projections form at least one annulus and said second device has a slot for the projections of said at least one annulus so that portions of said projections can enter the inlet of said gap.

8. The apparatus of claim 4, wherein said supporting surface has spaced-apart equidistant receiving means in which the commodities are partly received ahead of said inlet, said projections forming at least one annulus of spaced-apart equidistant projections and the mutual spacing of projections forming said at least one annulus being less than the mutual spacing of said receiving means.

9. The apparatus of claim 8, wherein said receiving means are flutes and said conveyor further comprises means for attracting the commodities to the respective flutes and for attracting the uniting bands to said supporting surface in predetermined portions of said path.

10. The apparatus of claim 1, wherein said second rolling means includes means for rolling the commodities about their respective axes through angles in excess of 360 degrees.

11. A method of convoluting adhesive-coated uniting bands around groups of coaxial rod-shaped articles, such as groups of plain cigarettes and filter mouthpieces in a filter tipping machine, comprising the steps of conveying a series of at least substantially equidistant groups along a predetermined path in a predetermined direction substantially at right angles to their respective axes and next to discrete uniting bands; setting successive groups of the series in rotary motion about their respective axes at a first speed so that the groups initiate conversion of the respective uniting bands into tubes which surround the groups; and thereupon rotating the already rotating successive groups about their respective axes at a higher second speed to advance the conversion of uniting bands into tubes.

12. The method of claim 11, wherein said step of setting in rotary motion includes frictionally engaging successive groups with successive projections of an annulus of projections which orbit adjacent said path at a speed less than the speed of movement of the groups along said path.

* * * * *